US007530358B2

(12) United States Patent
Elliott

(10) Patent No.: US 7,530,358 B2
(45) Date of Patent: May 12, 2009

(54) HAIR COLOR VARIEGATION DEVICE

(75) Inventor: Franklin Elliott, State College, PA (US)

(73) Assignee: EB Technologies, LLC, State College, PA (US)

( * ) Notice: Subject to any disclaimer, the term of this patent is extended or adjusted under 35 U.S.C. 154(b) by 31 days.

(21) Appl. No.: 11/728,242

(22) Filed: Mar. 23, 2007

(65) Prior Publication Data

US 2007/0221242 A1 Sep. 27, 2007

Related U.S. Application Data

(60) Provisional application No. 60/785,422, filed on Mar. 24, 2006.

(51) Int. Cl.
*A45D 19/18* (2006.01)

(52) U.S. Cl. ..... 132/270

(58) Field of Classification Search ..... 132/208, 132/212, 270, 111–116, 124–132
See application file for complete search history.

(56) References Cited

U.S. PATENT DOCUMENTS

| | | | | | |
|---|---|---|---|---|---|
| 734,704 | A | * | 7/1903 | Harrison | 132/115 |
| 3,349,781 | A | | 10/1967 | Poole et al. | |
| 3,749,105 | A | * | 7/1973 | Sestita | 132/208 |
| 4,165,754 | A | | 8/1979 | Di Pasqua | |
| 4,213,423 | A | * | 7/1980 | Bryan et al. | 119/605 |
| 4,325,393 | A | * | 4/1982 | Thomas | 132/151 |
| 5,024,243 | A | | 6/1991 | Snyder | |
| 5,152,306 | A | | 10/1992 | Stephan | |
| 5,303,722 | A | * | 4/1994 | Godfrey et al. | 132/219 |
| 5,337,765 | A | | 8/1994 | Wong | |
| 5,343,880 | A | | 9/1994 | McKay | |
| 5,482,058 | A | | 1/1996 | Garconnet | |
| 5,483,979 | A | | 1/1996 | Bertieri | |
| 5,562,111 | A | | 10/1996 | Torres | |
| 6,009,881 | A | | 1/2000 | Baudin et al. | |
| 6,012,462 | A | * | 1/2000 | Schmittou | 132/113 |
| 6,145,513 | A | | 11/2000 | Chu et al. | |
| 6,237,608 | B1 | | 5/2001 | Kari | |
| 6,286,518 | B1 | | 9/2001 | Laporte | |
| 6,334,449 | B1 | * | 1/2002 | Burrowes et al. | 132/114 |
| 6,357,449 | B1 | | 3/2002 | Chu et al. | |
| 6,367,483 | B1 | | 4/2002 | Chen et al. | |
| 6,691,712 | B2 | | 2/2004 | Chu et al. | |
| 6,694,986 | B2 | | 2/2004 | Alexander | |
| 2002/0185145 | A1 | * | 12/2002 | Mitchem | 132/112 |
| 2003/0075194 | A1 | * | 4/2003 | Ackermans et al. | 132/112 |
| 2003/0131864 | A1 | * | 7/2003 | Lu | 132/108 |
| 2004/0261808 | A1 | * | 12/2004 | Kluge | 132/115 |
| 2005/0028835 | A1 | | 2/2005 | Husband et al. | |
| 2006/0042643 | A1 | | 3/2006 | Delan | |

OTHER PUBLICATIONS

PCT Notification Concerning Transmittal of International Preliminary Report on Patentability, Oct. 23, 2008.

* cited by examiner

*Primary Examiner*—Robyn Doan
*Assistant Examiner*—Rachel R Steitz
(74) *Attorney, Agent, or Firm*—McQuaide, Blasko, Fleming & Faulkner, Inc

(57) ABSTRACT

A device for applying artificial color to selected stands of human hair, the device comprising a handle, a means for selecting strands of human hair, and a hair color applicator. The device allows a user to quickly, accurately, and predictably apply artificial color to selected strands of human hair using only one hand.

15 Claims, 5 Drawing Sheets

HAIR COLOR VARIEGATION DEVICE

REFERENCE TO RELATED APPLICATIONS

This application claims the benefit of the filing date under 35 U.S.C. § 119(e) of U.S. Provisional Patent Application No. 60/785,422 filed Mar. 24, 2006.

BACKGROUND OF THE INVENTION

1. Field of the Invention

The present invention relates generally to the coloring of human hair, and more particularly, to an improved method and device for quickly and effectively coloring human hair.

2. Background Art

Hair color variegation is a popular service performed by the professional beauty industry. The process involves the segregation of one or more sections of human hair followed by the treatment of the segregated hair with a hair coloring method or chemical. The technical skill required to separate particular sections of a person's hair from the remainder has kept this procedure mostly in the purview of hair salons.

A previously popular method for highlighting hair is described in U.S. Pat. No. 5,562,111. The method disclosed therein involves a cap tightly fitted over a scalp of combed-back hair. Strands of hair are then pulled through holes in the cap with a crochet hook and the exposed hair is colored to create the effect of variegation. Although this method can be somewhat successful at both keeping the chemical hair coloring from bleeding onto hair not intended for treatment and creating a generally variegated look, the necessity of drawing hairs through individual holes in the cap makes it difficult for the technician to consistently draw out a section of hair from the desired area without unintentionally entraining undesired sections of hair from areas surrounding the hole. The end result is unpredictable and, sometimes, very undesirable. Moreover, the available variegation pattern is dictated by the location and distribution of the holes in the cap. Additional disadvantages to this method include the inability to effectively color hair roots, the inability to consistently prevent the bleeding of color to adjacent sections of unselected hair, and the pain experienced by the recipient due to the repeated pulling of his or her hair through small holes. U.S. Pat. No. 4,165,754 is another example of a hair highlighting method employing a cap over the scalp. That method has the identical drawbacks of the '111 patent.

Alternatively, there are various combing methods used to apply hair color in a variegated manner. A general method involves dipping a comb into a liquid hair color and pulling the comb through the hair to be treated. Only relatively large sections of hair can be treated in this manner and it is difficult for the operator to avoid color bleeding onto hair not intended for treatment. U.S. Pat. No. 3,349,781 describes a method wherein a hair stylist parts hair into sections and uses a brush with a series of spaced tufts to brush streaks onto random strands. The tufts of the brush are dipped into a hair color composition and retain the composition until the brush is drawn across the strands to be colored, thus depositing the artificial colorant thereon. This method utilizes protective sheets placed under and over the streak-treated partings before and after treatment to avoid color bleeding to adjacent hair. However, using this brush method makes it difficult to choose which strands of hair will be treated. Hence, there is minimal control over the placement of the hair treatment. Therefore, larger sections of hair are treated, resulting in a more unnatural hair coloring effect.

U.S. Pat. No. 5,337,765 describes a modular brush for applying hair color compositions with a brush body and detachable bristle modules so that the brush can be configured to achieve a user-defined variegated pattern. However, this apparatus presents the same limitations as described above for the '781 patent.

A more commonly used technique by those skilled in the art involves selecting hair through weaving with a conventional tail comb and then placing the selected sections onto aluminum foil (or some other barrier material) and then painting the selected sections with a hair color composition. A dispensing device for metallic foil that may be used in this process is disclosed in U.S. Pat. No. 6,237,608. The foil method allows for smaller, more independent, more consistently variegated sections to be treated, resulting in a more naturally variegated final appearance. When using this method, the potential for color bleeding onto surrounding hair is reduced. The foil method is also more effective for applying color composition to the segregated sections of hair as close to the scalp as possible. However, even with these advantages over other hair coloring procedures, the foil method is very time consuming and expensive. For an average client, at least 30 to 50 minutes is required to complete this method of hair coloration.

Hair color variegation techniques that involve color treated sections that have been woven away and placed inside a barrier material for processing produce natural and attractive variegated appearance. It follows then that advancement in the field of hair color variegation involves weaving, color treatment and barrier material. Reference will now be made to technology that attempts to advance on one or more of these three general systematic elements.

U.S. Pat. Application No. 2005/0028835 discloses "A Device For Dispensing a Barrier Material to a Lock of Hair." This device can be generally understood (although some of the embodiments vary greatly) as being comprised of two tape dispensers that are hinged at the roll end. The tape dispenser end (distal to the roll end) opens and closes in such a way as to cause the faces of the two tapes to touch. A section of hair can be chosen and encapsulated between the two tapes. The face of one or both of the tapes is treated with one or both of the chemical hair color components. The embodiments also include means within the device to apply hair color just before the hair is encapsulated within the tape. This method, although saving time and product, still lacks the ability to automatically, quickly and accurately weave away a plurality of selected hair sections for variegation purposes.

U.S. Pat. No. 5,152,306 discloses a hair-weaving comb that has regular teeth and inwardly barbed teeth attached alternately across the spine of the comb. In practice, a thin section of hair is parted away from the scalp. The teeth of the comb are then pushed into the parting and drawn back out. The barbed teeth pick up sections of hair while the straight teeth do not. An operator grabs the hooked hair, pulls the comb away and lets the non-hooked hair fall. This device allows for a faster and more consistent weave than the manual hair weaving method. However, it does not offer any device or method to apply color or barrier material. In addition, the device does not effectively pick up sections of hair in a predictable manner, nor does it pick up hair against a curved scalp surface.

U.S. Pat. No. 5,024,243 discloses a comb/color applicator combination. The device discloses a comb with a hollow spine that screws onto a container filled with chemical color composition. When the container is squeezed, the chemical composition fills the hollow spine of the comb and exits the spine through small holes positioned in between the teeth of the comb. Although this device will yield a variegated hair color appearance, there is a substantial risk of color bleeding because the variegated hair is not woven away from the rest, and the device fails to provide the technician with a high degree of control or accuracy.

U.S. Pat. No. 5,303,722 describes a hair lightening method involving the use of an optical photosensitizer and a compound capable of providing a hydrogen radical (ethanol is preferred) in a solution. The solution is applied to the hair and then left to saturate for 5 to 60 minutes. Low intensity ultraviolet light (typically provided by a comb or hood) is then applied to the hair causing a hydrogen to be exchanged between the two components in the solution, thereby creating hydrogen peroxide inside the hair shaft. The peroxide is excited by the light causing some of the hair pigment (melanin) to be destroyed. As a result, the hair subjected to the process is lightened. Using this same photochemical reaction, the '722 patent describes a method whereby the entire head of hair is saturated with the photosensitive solution followed by the segregation of small sections of hair by manual weaving. The non-segregated hair is masked with an opaque material so that only the segregated hair is exposed to the low intensity ultraviolet light. The result is a "highlight" effect among the segregated hair strands. The techniques described in the '722 patent involve considerable time and manual labor.

U.S. Pat. No. 4,325,393 discloses a hooking mechanism for hair coloration. The implement has a plurality of equidistantly spaced, accurate hook members movable between open and closed positions with respect to the bottom surface of the body of the implement by an operating slide member at its top. After thus hooking and engaging spaced groups of hair strands for treatment, the implement is lifted from the scalp to isolate the strand groups for bleach or dye treatment. This implement does not offer the operator nearly the degree of control that is inherent in the instant invention. Although the bottom surface of the device is curved, it does not flexibly conform to the curve of the head. This prohibits the device from uniformly selecting portions of hair.

More importantly, a major drawback results from the fact that the '393 patent discloses a hooking arrangement that moves from an open to closed position by partially rotating on an axis that is approximately 1½ of its own hook diameter lengths above the actual hook. Thus, the hooks "swing" through an opening at the bottom surface of the body from a point just inside the body. The hooks swing from a not entirely open position to a not entirely closed position. The "swinging hook" will not entrain hair as effectively or as precisely as a hook that rotates out of a body spinning from its radial center, as do the hooks in the preferred embodiment of the present invention. Furthermore, the '393 patent offers no means by which the hooked hair can have a variable tension applied to it when the hooks are in the closed position. Hair may be hooked away from the scalp, but it cannot be held against tension; the hair will simply slide through hooks when the operator pulls the device away from the head. Finally, the '393 patent does not include any means by which it can apply color compositions or processing accelerators (e.g., heat, light), nor any means to assure a safe and controlled contact with the scalp by the swinging hooks.

U.S. Patent Application No. 2006/0042643 discloses a hair highlighting tool. However, the disclosed invention does not address the multiple problems overcome with the instant invention. In fact, it may exacerbate some of the problems regarding the regulation and control of hair coloration.

All of the above-cited prior art addresses certain needs. However, none solves the time, consistency and control problems that are encountered when performing the manual hair color variegation technique presently most popular in the purview of the hair salon. In addition, none have successfully combined mechanical elements into a single device to give it the ability to do all that is mentioned in the present disclosure. Accordingly, there is a need for a hair coloration device that safely, accurately, predictably, and quickly applies colorant to uniformly selected and entrained portions of hair.

SUMMARY OF THE INVENTION

The present invention is a hair coloration device that quickly, accurately, predictably, and safely applies hair color to selected strands of hair. The device is held by a handle and activated by a trigger using the index finger. The main body, or chassis, of the device extends forward perpendicularly from the top of the handle, ending distal to the top of the handle in an array of "floating heads," preferably, more than three, and more preferably, five or more floating heads. Each of the floating heads includes a hooking mechanism, that, when in contact with the scalp, has the ability to safely hook, or entrain, a single small stalk or section of hair away from the scalp and apply a variable tension to it. The hooking mechanism generally consists of a hook and a hooking platform. When the aligned array of floating heads are applied parallel to and approximately ⅛ of an inch below a straight parting of hair, certain embodiments of the invention allow each floating head to individually flex into accurate contact with the varying curvature of the scalp. In other embodiments, the floating heads are aligned along a contoured base designed to conform with the curvature of the scalp. Once the hooking platforms of the floating heads have made contact with the scalp, the trigger is pulled and each floating head hooks and entrains a strand of hair, and grasps it between the hooking platform and the hook.

As each hook rotates on its axis through its course from its resting position on the tops of the hooking platforms to the point where the hooks have lifted stalks of hair away from the scalp, the hooks only make light, controlled contact with the scalp. Once the hooks have entrained strands of hair, the more pressure that is applied to the trigger, the tighter the hair is grasped between the hook and hooking platform.

A preferred embodiment of the present invention includes an array of liquid hair color applicators that are removable and interchangeably membered to the top front portion of each floating head. A preferred embodiment of the liquid hair color applicator comprises a reservoir, a platform and a fluid dispensing means, such as a strip of felt or other suitably porous material capable of capillary action, or a roller ball or rotating cylinder. The fluid dispensing means shall be generally referred to herein as the "wick." One end of the wick extends into the reservoir while the other runs along the bottom of the hooking platform. Accordingly, when the stalks of hair are grasped between the hooks and hooking platforms, the stalks are pressed against the wick, thereby applying liquid to the hair. The liquid may be a chemical colorant, hair mascara, henna, or other types of temporary, semi-permanent or permanent hair color compositions. As a result, when the floating heads are urged against a parting of hair and the trigger is pulled, hooking and therefore entraining a plurality of stalks of hair away from the scalp, an operator may maintain a certain pressure on the trigger and proceed to pull the device away from the scalp thereby coating the stands of hair with liquid hair color from a point very close to the scalp to the ends of the strands, or any point between. When the trigger is released, the hooks will release by rotating in a radial fashion away from the bottoms of the platforms completely releasing the hair color coated stalks of hair.

Each liquid hair color applicator can be designed to include a reservoir with two or more chambers and/or two or more wicks, so that two products or chemicals can be combined at the point of contact with the entrained hair to cause or catalyze a desired chemical reaction to the hair. The chemical reaction may occur as the two chemicals are mixed outside the liquid hair color applicator on the entrained hair. Alternatively, the chemicals could be mixed in the applicator. For instance, hydrogen peroxide could be contained in one chamber and an ammonia based dye precursor mixture could be contained in another. The two chambers can be separated by an thin membrane (e.g., a thin layer of plastic) that can be easily broken bending or squeezing the liquid hair color applicator. By breaking the thin membrane, the chemicals in both chambers mix and create a new compound. The mixing can also be accomplished with a removable barrier between the chambers that can easily be removed after the reagents have been poured into the separate chambers.

In other embodiments, one chamber is placed in front of another chamber inside the reservoir. In such embodiments, each chamber could have its own wick. As the hair color applicator is dragged along the surface of the hair, the reagent in the front chamber is applied to the hair first. After that, the reagent in the back chamber is applied to the hair on top of the reagent that was in the front chamber. In effect, this allows the reagents in both chambers to mix after being applied to the entrained strands of hair. These embodiments allow the chemical reaction necessary to artificially color the entrained hair to take place after the reagents have been applied to the hair.

In yet another embodiment of the invention, a source of light can be added to the device and directed to the point where the hair color applicator contacts the entrained hair. The light source can be produced with optical fibers or lasers, or other such means known in the art. The light source should produce the required wavelength(s) to catalyze or activate the desired chemical reaction at the point where the hair color applicator applies a photosensitive hair color composition to the entrained hair. As the entrained hair is pulled through the hooks, the hair color applicator applies a photosensitive hair color composition to the hair. The photosensitive chemical then comes into contact with the light source causing a chemical reaction to occur that colors the hair.

In other embodiments, the hooking mechanism can be manufactured to heat up (e.g., by sending an electric current through a hooking mechanism capable of electric conduction) and apply heat to the entrained strands of hair The advantages and features of novelty characterizing the present invention are pointed out with particularity in the appended in Appendix A, including specific examples of how the device may be utilized to save hair stylists substantial amounts of time in coloring hair. To gain an improved understanding of the advantages and features of novelty, however, reference may be made to the following descriptive matter and accompanying drawings that describe and illustrate various embodiments and concepts related to the invention.

DETAILED DESCRIPTION OF THE INVENTION

The present invention is a trigger-operated, hand-held device that is used to selectively entrain and color human hair. The invention solves separate and distinct needs of professional hair stylists and individuals desiring the artificial coloring of their hair.

Figure 1:
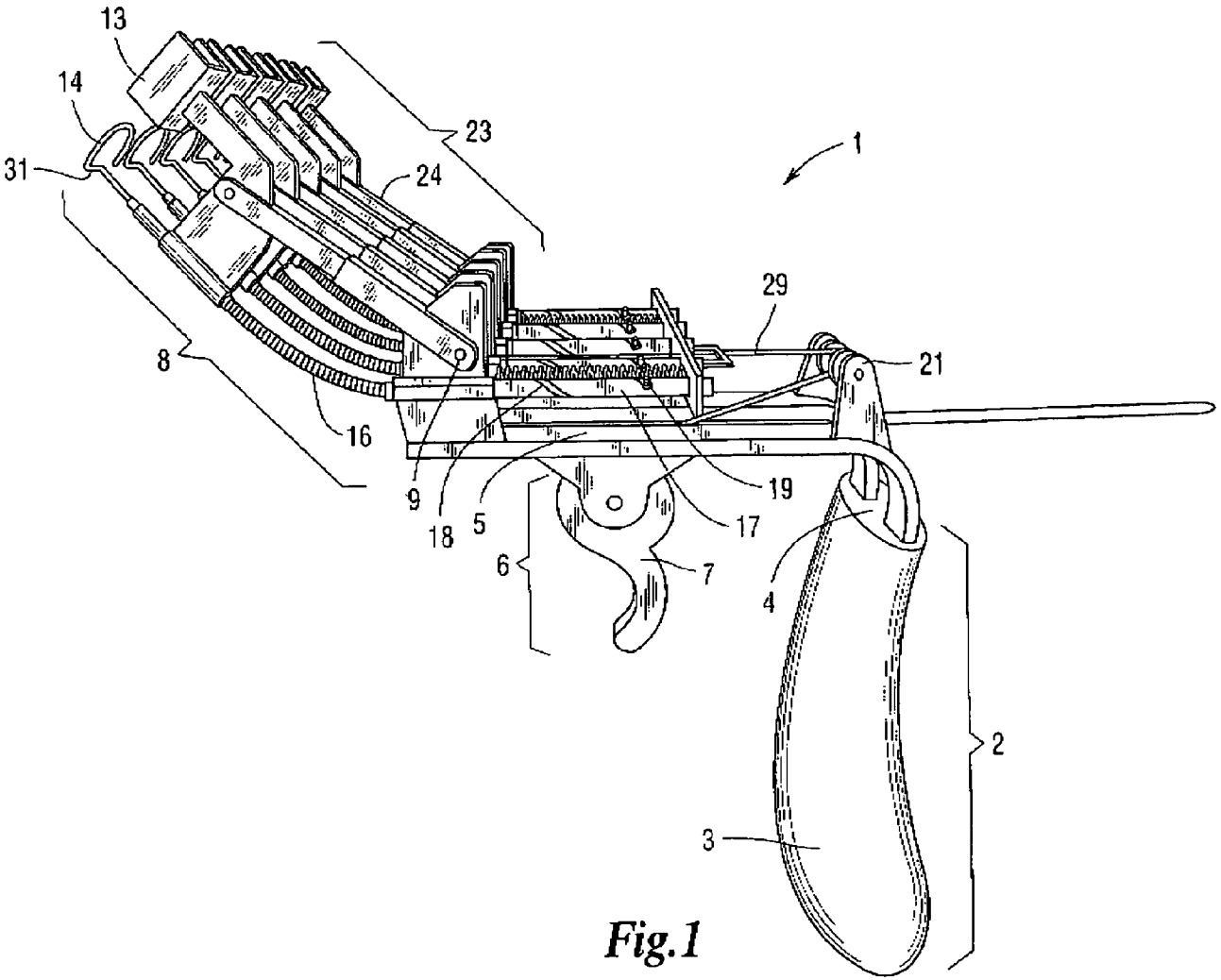
FIG. 1 is a perspective view of the hair color variegation device according to the present invention showing the trigger-operated grip, a series of five (5) independently mounted floating heads, and the connection of the trigger mechanism to the rotating hooks located at the ends of the floating heads in various embodiments.

Each of the figures illustrates embodiments of the hair coloring device 1. As shown in FIG. 1, the device 1 includes a handle 2, having a first end 3, configured to be gripped by a user, and a second end 4 adapted to connect to a chassis 5. The handle 2 is preferably four and one-half (4½) inches (10.5 cm) in length, but may be made in various lengths. The handle 2 can be glued, frictionally fitted, or bonded to the chassis 5, as shown in FIG. 1. The chassis 5 is preferably five (5) inches (12.5 cm) in length, but may be made in various lengths. The handle 2 and chassis 5 of the device 1 may be made from a variety of materials (e.g., plastic, wood) depending on design considerations.

As shown in FIG. 1, a trigger mechanism 6 is attached to the base of the chassis 5 in front of the handle 2. The trigger mechanism 6 is a simple lever that allows a user of the device 1 to pull the trigger 7 of the trigger mechanism 6 towards the handle 2. As will be explained in more detail, pulling the trigger 7 causes the rotating hook mechanism 11 to rotate, which causes the rotating hook mechanism 11 to entrain a strand of hair when the device 1 is positioned against a section of cranial hair.

Referring to FIG. 1, atop the chassis 5 are attached a floating head 8. The floating head 8 is preferably three and one-half (3½) inches (8 cm) in length, but may be made in various lengths. The floating head 8 may be made from a variety of durable materials (e.g., plastic, metal) depending on design considerations. In the preferred embodiment of the invention, there are at least five (5) floating heads 8 attached to the chassis 5. As shown in greater detail in FIG. 2 and FIG. 3A, the floating head 8 consists of: (1) a rotating hook mechanism 11; (2) a means 12 for causing the rotating hook mechanism 11 to rotate; (3) a channel mount 13; (4) a stabilizing mechanism 23; (5) a hooking platform 30; and (6) a hair color applicator 22. Additional details regarding the mechanical design of a specific embodiment of the instant invention are contained in Appendix A.

Figure 3A:
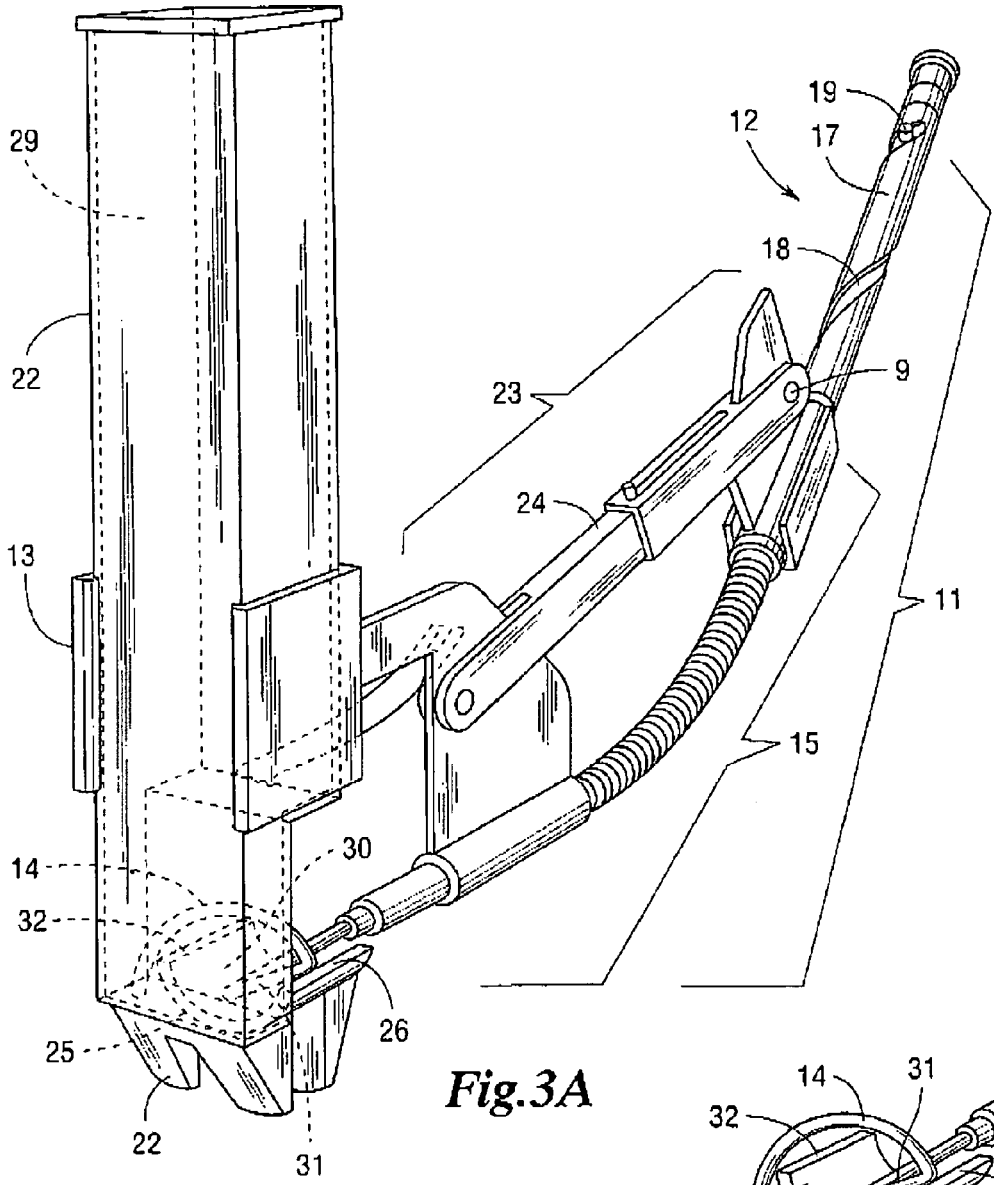
FIG. 3A is a perspective view of a floating head of the hair color variegation device showing the hooking platform, the means for rotating the hook and the means by which a detachable hair color applicator applies hair color composition to the strands of hair selected by the rotating hook in varied embodiments.
Figure 3B:
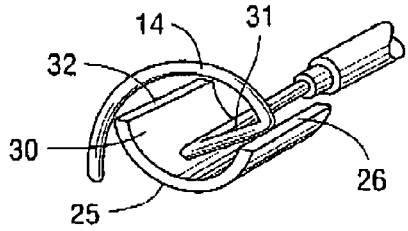
FIG. 3B is a perspective view of the rotating hook mechanism and the hooking platform that have been isolated from a floating head of the hair color variegation device.

Referring to FIG. 3A and FIG. 3B, the rotating hook mechanism 11 includes a hook 14 attached to the front of a thin, flexible rod 15. The hook 14 is preferably crescent shaped and affixed to the front of the thin, flexible rod 15 in such a way as to allow the hook 14 to rotate 180° from an "open" position to a "pinching" position. The hook 14 is preferably made of metal, but can be made of any durable material. In various embodiments of the invention, the thin flexible rod 15 comprises a tightly wound coil spring 16 approximately one (1) inch long by approximately one-eighth (⅛) of an inch in diameter with a round metal (or other suitable material) rod attached to both ends.

Figure 2:
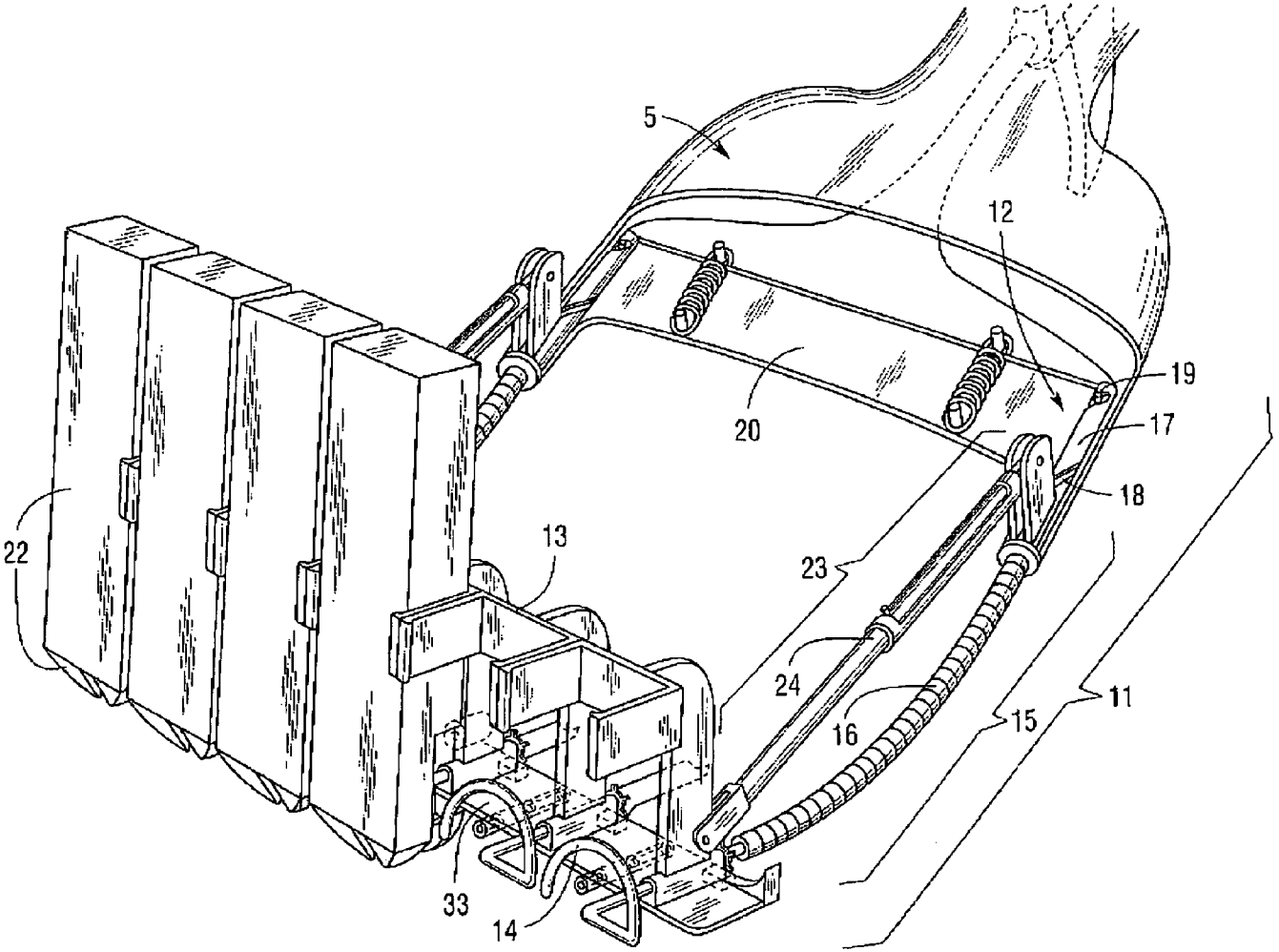
FIG. 2 is a perspective view of floating heads in an alternative embodiment of the hair color variegation device showing the manner in which the series of floating heads may be affixed to the platform in order to conform to the contour of the head.

The means 12 for causing the rotating hook mechanism 11 to rotate is located at the end of the thin, flexible rod 15 opposite the hook 14. In one embodiment of the invention, the means 12 consists of a hollow tube 17 encasing the end of the thin, flexible rod 15. A spiral channel 18 is cut along the length of the hollow tube 17, and a peg 19 is affixed to the thin, flexible rod 15 in such a way as to protrude through the spiral channel 18. As shown in FIG. 1 and FIG. 2, the hollow tube 17 is attached to a bracket 20. The bracket 20 slides freely along the top of the chassis 5. The bracket 20 is attached to the trigger mechanism 6 (such as by a simple pulley 21 and cable 29 as shown in FIG. 1) in such a way as to cause it to slide away from the floating head 8 when the trigger 7 is pulled. Additional details regarding the mechanical hooking mechanism design of a specific embodiment of the instant invention is contained in Appendix A, including one possible locking mechanism. Alternative mechanical designs well known to one skilled in the art may be utilized to activate the floating head 8, including motor-driven means. When the bracket 20 slides away from the floating head 8, the thin, flexible rod 15 is pulled out through the hollow tube 17. When the thin, flexible rod 15 is pulled out through the hollow tube 17, the peg 19 follows the path of the spiral channel 18 causing the thin, flexible rod 15 to rotate, which thereby causes the hook 14 to rotate. While an embodiment of the rotating hook mechanism 11 allows the thin, flexible rod 15 to easily rotate when the trigger 7 is pulled, any other means of rotating the thin, flexible rod 15 may be used. Such means will be well understood by one skilled in the art.

As shown in FIG. 2 and FIG. 3A, the stabilizing mechanism 23 connects the floating head 8 to the chassis 5 in a position distal to the handle 2. Preferably, the stabilizing mechanism 23 allows the floating head 8 to be attached to the platform 5 in such a way that allows the floating head 8 to pivot on an axis. For example, the stabilizing mechanism 23 can comprise a simple hinge 9. As an alternative, the stabilizing mechanism 23 can comprise a telescoping rod 24 connecting the floating head 8 to the chassis 5. Various embodiments of the stabilizing mechanism 23 are shown in FIG. 2 and FIG. 3A. The stabilizing mechanism 23 may be made from a variety of durable materials (e.g., plastic, metal) depending on design considerations.

Referring to FIG. 2 and FIG. 3A, The channel mount 13 is affixed to the top of the floating head 8. The channel mount 13 is constructed of a durable material (e.g., plastic, metal) and positioned above the hook 14 of the rotating hook mechanism 11. The channel mount 13 is shaped in such a way as to firmly and securely hold a hair color applicator 22 in place, yet allow a hair color applicator 22 to be easily removed therefrom. In some embodiments, the channel mount 13 is open on the top, front, and bottom as depicted in FIG. 2. Additional details regarding the mechanical design or one possible embodiment of the instant interchangeable cartridge mechanism is set forth in Appendix A.

As shown in FIG. 3A and FIG. 3B, various embodiments of the hooking platform 30 comprise a concave channel of a durable material (e.g., plastic, metal) shaped and dimensioned to attach to the base of the floating head 8 with the base 25 of the hooking platform 30 lying just below the center of the circular face of the hook 14, and the sides 26, 32 of the hooking platform 30 curling upward toward the channel mount 13. The hook 14 is positioned in such a way relative to the hooking platform 30 so that when the hook 14 is rotated, such as by the means 12 depicted, the hook rotates underneath the base 25 of the hooking platform. When the interior radius 31 of the hook 14 rotates from its beginning position at one side 26 of the hooking platform 30 around to the other side 32 of the hooking platform 30, the interior radius 31 of the hook 14 applies downward pressure to the hooking platform 30 as the hook continues to rotate. The downward pressure causes the base 25 of the hooking platform 30 to eventually press against the hook 14. This allows the hook 14 and hooking platform 30 to "pinch" or entrain the strands of hair that have been placed in between the hook 14 and hooking platform 30 by the rotation of the hook 14, thereby allowing the user of the device 1 to pull the selected strands against tension. The invention allows for the predictable and uniform entrainment of strands of hair.

Figure 4:
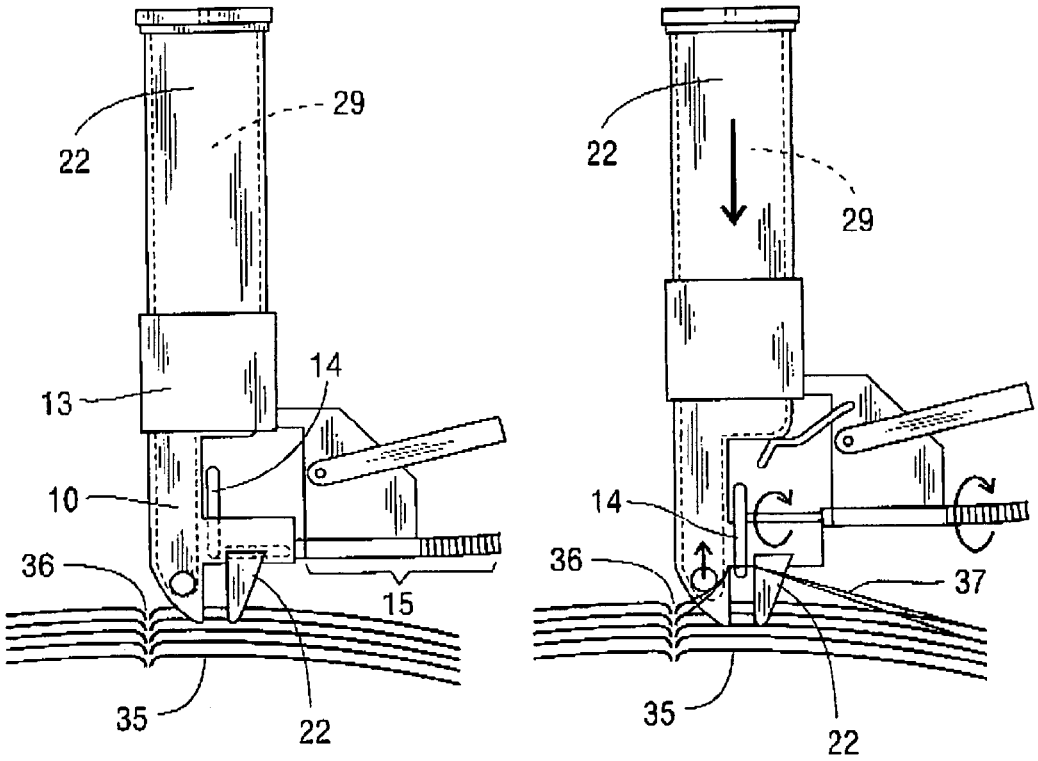
FIG. 4 is a series of lateral views of a floating head of the hair color variegation device positioned in close proximity to a person's cranial hair.

As shown in FIG. 3A, and 4, an optional hair color applicator 22 is attached to the floating head 8 at the channel mount 13. In various embodiments of the invention, the hair color applicator 22 includes a reservoir 29 for storing hair color composition and a wick 10 for applying the hair color composition to the stands of hair selected by the device 1. The reservoir 29 can store any hair color composition that is typically used in the field to color human hair (e.g., hydrogen peroxide, ammonia based dye precursor mixture, bleach). The type of hair color composition stored in the reservoir 29 will depend on the desired hair color. The top of the wick 10 is in constant contact with the reservoir 29. The base of the wick 10 is positioned outside of the hair color applicator 22 and at the point where the hook 14 and the hooking platform 30 "pinch" the selected strands of hair. In some embodiments of the invention, the wick 10 is made of a semi-porous substance that allows the hair color composition to drain from the reservoir 29 and then be applied to the hair when placed in contact with the surface or the hair. For example, the wick 10 can be made of felt and operate similar to a standard felt-tipped pen. The rate of hair color composition flow through the wick 10 can be controlled in a number of ways typically understood in the art, including the addition of a hole to the top of the hair color applicator 22 allowing the air pressure in the reservoir 29 to normalize and thereby increasing the flow rate of the hair color composition through the wick 10.

In other embodiments of the hair color applicator 22, the wick 10 is a sealing mechanism at the base of the reservoir 29. For example, a roller ball mechanism can be used as the wick 10 to seal the base of the reservoir 29. The roller ball mechanism can consist of a metal or plastic sphere positioned inside the reservoir 29 and having a circumference slightly larger than the circumference of he opening at the base of the reservoir 29, with the bottom of the sphere protruding outside the reservoir 29. The entrained strands of hair are brought in contact with the bottom of sphere. The majority of the sphere's surface is in contact with the liquid contained in the reservoir 29 when the device 1 is not in use. As the entrained strands are pulled through the device 1, the sphere rotates and brings the liquid contained inside the reservoir 29 into contact with the entrained strands. After applying the liquid to the entrained strands, the sphere continues to rotate and repeats the process as the entrained strands are pulled along. The roller ball mechanism may be spring activated.

In other embodiments of the hair color applicator, the sealing mechanism can comprise a simple seal that seals the opening at the base of the reservoir 29 from the inside of the reservoir 29 when the device 1 is not is use. For example a piece of plastic large enough to cover the opening at the base of the reservoir 29 that is hinged on one side of the opening can serve as sealing mechanism. When the hook 14 and the hooking platform 30 "pinch" the selected stands of hair, the seal is pushed away from the opening at the base of the reservoir 29 and the hair color composition flows onto the selected strands of hair. When the "pinching" of the hook 14 and the hooking platform 30 is released, the sealing mechanism seats back onto the opening at the base of the reservoir 29 and the flow of hair color composition is stopped through the formation of a seal.

In one embodiment of the hair color applicator 22 shown in FIG. 4, the wick 10 is a cylinder positioned adjacent to the hook 14 when the hook 14 is in the "pinching" position. The cylinder is attached to the hair color applicator 22 in such a way as to allow it to spin. As the device 1 is pulled along the selected strand 37 of hair 35, the cylinder comes into physical contact with the strand 37 causing the cylinder to spin. As the cylinder spins, it captures hair colorant in the reservoir 29 and then, as it continues to spin, applies the colorant to the selected strand 37. The cylinder can be made of any durable material (e.g., plastic) and can have a semi-porous affixed to its length to better absorb the hair colorant. Spiral grooves can also be added to the surface of the cylinder's length to ensure the hook 14 does not remove the hair colorant from the cylinder when the cylinder presses against the hook 14.

FIG. 4 demonstrates how the hook 14 can select a strand 37 of hair 35, and thereby apply artificial color to the selected strand 37. The left slide of FIG. 4 shows the hook 14 in the "open" position. While the hook 14 is in the "open" position, the bottom of the floating head 8 is positioned against a person's cranial hair 35, preferably at the beginning of a parting 36 of the cranial hair 35. The thin, flexible rod 15 is then rotated, as shown in the right slide of FIG. 4, which causes the hook 14 to rotate around and underneath a strand 37 of hair 35. The right slide of FIG. 4 shows the hook 14 in the "pinching" position. By selecting the strand 37 and then lifting it, the hook 14 brings the strand 37 in contact with the wick 10. The floating head 8 is then pulled away from the part 36. The length of the strand 37 is thereby pulled through the floating head 8 and against the wick 10. Hair color composition is drained from the reservoir 29 of the hair color applicator 22 and onto the selected strand 37.

In the preferred embodiment of the device 1, each floating head 8 is independently attached to the chassis 5. In the embodiment shown in FIG. 1, each floating head 8 has an independent stabilizing mechanism 23 that attaches to the chassis 5. In the alternative embodiment shown in FIG. 2, each floating head 8 is affixed to a flexible base 33. Stabilizing mechanisms 23 are attached to the lateral ends of the flexible base 33. The stabilizing mechanisms 23 then attach the flexible base 33 to the chassis 5. The flexible base 33 can be made of any flexible material (e.g., rubber, plastic) or any solid material with regular hinges positioned throughout to allow each individual floating head 8 to pivot on at least one (1) axis.

Figure 5:
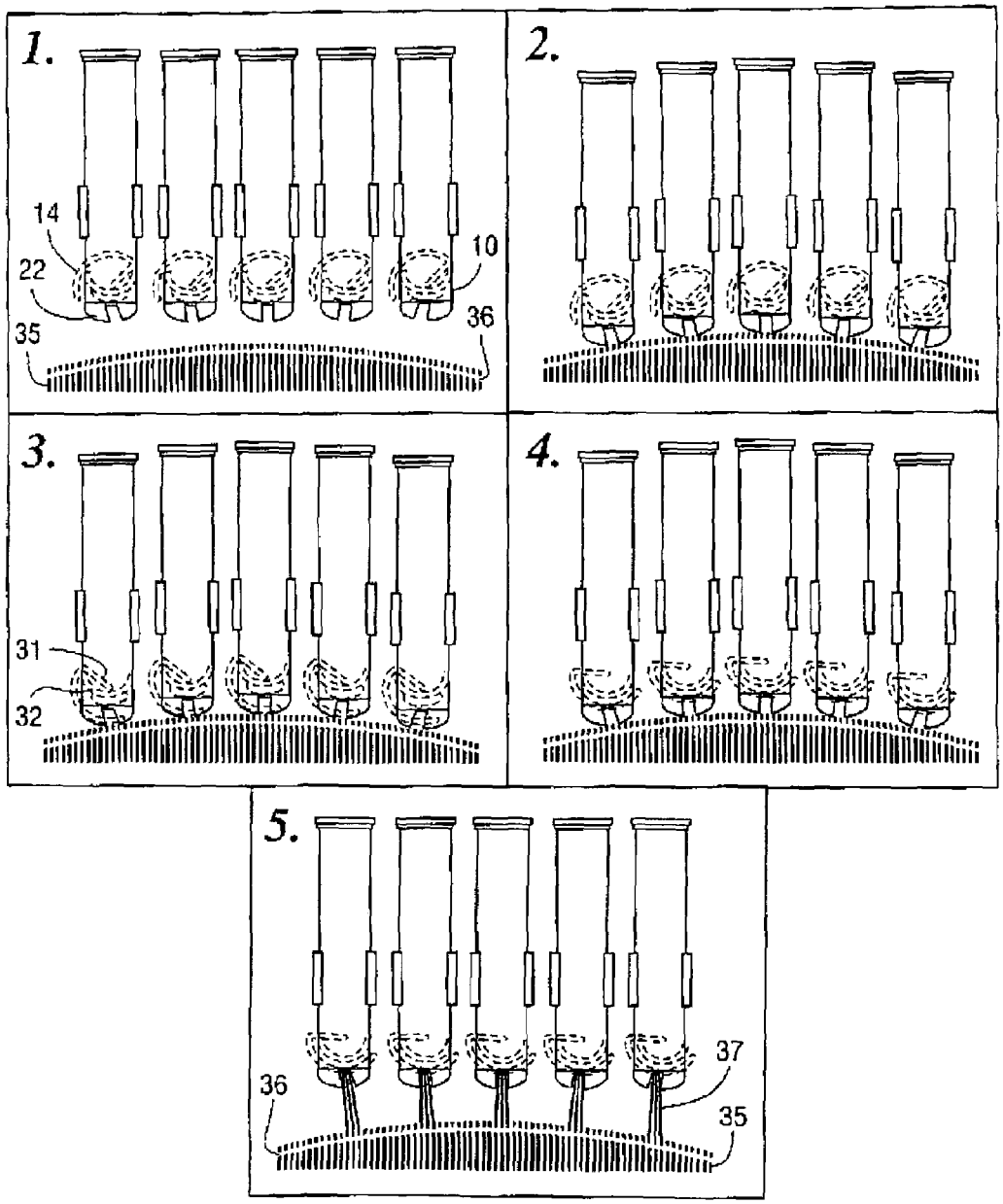
FIG. 5 is a series of anterior views of five floating heads of the hair color variegation device positioned in close proximity to a person's cranial hair.

FIG. 5 demonstrates the use of the preferred embodiment of the device 1. In slide 1 of FIG. 5, the floating heads 8 are positioned above a part 36 of cranial hair 35. In slide 2 of FIG. 5, the floating heads 8 are pressed against the hair 35, causing the device 1 to "flex" the floating heads 8 into positions that contour to the surface of the hair 36. The hook 14 is then rotated into the "pinching" position, as shown in slide 3 and slide 4 of FIG. 5. As shown in slide 5 of FIG. 5, the floating heads 8 are pulled away from the part 36 of hair 35 allowing the selected strands 37 of hair 35 to be pulled against tension.

The present invention has been described with respect to certain preferred embodiments and conditions that are not meant to, and should not be, construed to limit the scope of the invention. Those skilled in the art will understand that variation from the embodiments and conditions described herein may be made without departing from the invention as defined in the appended claims. Any element in a claim that does not explicitly state "means for" performed a specific function, or "step for" performing a specific function, in not intended as a "means" or "step" clause as specified in 35 U.S.C. § 112, ¶ 6.

What is claimed is:

1. A device for selectively entraining hair strands from the scalp, comprising:

(a) a plurality of hooking platforms, each including a platform base and a hook that is mechanically activated to rotate on an axis at or near a center of an arc of the hook, said hooking platforms being mounted such that one or more of said platforms comprises an independently flexible position relative to a curved surface, one or more of said hooking platforms being adjacent the curved surface of a scalp;

(b) a hair color applicator body having two intersecting and recessed channels at its base, one channel through which the hook travels, and a second channel through which will protrude a hair parting; and wherein the travel of said hook extends to a position no lower than generally flush with a bottom surface of said hair color applicator body.

2. The device of claim 1, wherein an interior radius of the hook comprises a rotation pathway wherein said hook is placed into contact with an end of the platform base for hair strand entrainment against an underside of said platform base.

3. The device of claim 2, further comprising a valve being operably connected by said hooking platform to a reservoir of liquid for contacting entrained hair strands.

4. The device of claim 3, wherein said hair color applicator body further comprises one or more removable and replaceable cartridges, said liquid reservoir being retained therein.

5. The device of claim 2, further comprising a wick component being operably connected by said hooking platforms to a reservoir of liquid for contacting entrained hair strands.

6. The device of claim 5, wherein said hair color applicator body further comprises one or more removable and replaceable cartridges, said liquid reservoir being retained therein.

7. The device of claim 1, wherein one or more of said hooking platforms further comprises variable pressure activation for hair strand entrainment coincident with movement of the device along a length of the entrained hair.

8. The device of claim 1, further including a light source mounted to the device for directing light to a point of contact between a hair treatment liquid and entrained hair strands.

9. The device of claim 1, further including a heat source mounted to the device for applying heat to entrained hair strands.

10. A method for selectively entraining hair strands from the scalp, comprising:

(a) employing a device having a plurality of hooking platforms, each including a platform base and a hook that is mechanically activated to rotate on an axis at or near a center of an arc of the hook, a hair color applicator body having two intersecting and recessed channels at its base, one channel through which the hook travels, and a second channel through which will protrude a hair parting; wherein the travel of said hook extends to a position no lower than generally flush with a bottom surface of said hair color applicator body;

(b) activating the hooking platforms and hooks for entraining hair strands against an underside of the platform base, the hooking platforms mounted such that one or more of said platforms is independently flexible relative to a curved surface and is capable of being positioned adjacent the curved surface of a scalp; and (c) allowing a source of one or more hair treatment liquids to contact the entrained hair strands.

11. The method of claim 10, further comprising applying variable pressure to activate one or more of said hooking platforms and hooks for entraining hair strands against an underside of the platform base coincident with movement of the device along a length of the entrained hair.

12. The method of claim 10, further comprising retaining one or more of the hair treatment liquids in said hair color applicator body.

13. The method of claim 10, further comprising retaining said hair treatment liquids in one or more removable and replaceable cartridges within said hair color applicator body.

14. The method of claim 10, further comprising directing light to a point of contact between a hair treatment liquid and said entrained hair strands.

15. The method of claim 10, further comprising applying heat to said entrained hair strands.

* * * * *